US008963827B2

(12) United States Patent
Kim et al.

(10) Patent No.: US 8,963,827 B2
(45) Date of Patent: Feb. 24, 2015

(54) DISPLAY APPARATUS HAVING A MICRO-SHUTTER AND METHOD OF DRIVING THE SAME

(75) Inventors: Jung-taek Kim, Daejeon (KR); Unggyu Min, Namyangju-si (KR); Cheolwoo Park, Suwon-si (KR)

(73) Assignee: Samsung Display Co, Ltd., Yongin, Gyeonggi-Do (KR)

( * ) Notice: Subject to any disclaimer, the term of this patent is extended or adjusted under 35 U.S.C. 154(b) by 302 days.

(21) Appl. No.: 13/435,580

(22) Filed: Mar. 30, 2012

(65) Prior Publication Data

US 2013/0076713 A1 Mar. 28, 2013

(30) Foreign Application Priority Data

Sep. 27, 2011 (KR) ..... 10-2011-0097722

(51) Int. Cl.
*G09G 3/34* (2006.01)

(52) U.S. Cl.
CPC ..... *G09G 3/34* (2013.01); *G09G 3/3433* (2013.01); *G09G 3/3453* (2013.01)
USPC ..... 345/109

(58) Field of Classification Search
CPC ..... G09F 9/372–9/375; G09F 11/28; G02B 26/001; G02B 26/0841; G02B 6/353; G02B 6/3552; G02B 6/3572; B60R 11/0235; B60K 35/00
USPC ..... 345/108–111, 85, 86; 359/290–296
See application file for complete search history.

(56) References Cited

U.S. PATENT DOCUMENTS

| | | | | |
|---|---|---|---|---|
| 5,285,407 | A * | 2/1994 | Gale et al. | 365/189.11 |
| 2005/0001828 | A1* | 1/2005 | Martin et al. | 345/204 |
| 2006/0250325 | A1 | 11/2006 | Hagood et al. | |
| 2007/0086078 | A1* | 4/2007 | Hagood et al. | 359/298 |
| 2008/0129681 | A1* | 6/2008 | Hagood et al. | 345/109 |
| 2008/0174532 | A1* | 7/2008 | Lewis | 345/85 |
| 2010/0134390 | A1 | 6/2010 | Shin et al. | |
| 2011/0148948 | A1* | 6/2011 | Gandhi et al. | 345/690 |
| 2011/0164067 | A1* | 7/2011 | Lewis et al. | 345/690 |

FOREIGN PATENT DOCUMENTS

JP 2001-337304 7/2001

* cited by examiner

*Primary Examiner* — Sanghyuk Park
(74) *Attorney, Agent, or Firm* — F. Chau & Associates, LLC

(57) ABSTRACT

A display apparatus includes a micro-shutter including first and second electrodes, a latch circuit including first and second input nodes, and first and second output nodes to receive an operation voltage and a common voltage, a capacitor including a first electrode and a second electrode applied with a shutter voltage, a first switching device applying a data signal to the first electrode of the capacitor in response to a gate signal, and a second switching device applying the voltage of the first electrode of the capacitor to the first input node of the latch circuit in response to an update voltage.

20 Claims, 16 Drawing Sheets

DISPLAY APPARATUS HAVING A MICRO-SHUTTER AND METHOD OF DRIVING THE SAME

CROSS-REFERENCE TO RELATED APPLICATION

This application claims priority to Korean Patent Application No. 10-2011-0097722, filed on Sep. 27, 2011, the disclosure of which is incorporated by reference in its entirety herein.

1. Technical Field

Embodiments of the present invention relate to a display apparatus and a method of driving the same.

2. Discussion of Related Art

A micro-shutter display apparatus employing a micro-shutter as a microelectromechanical system may have a higher response speed than a liquid crystal display. The micro-shutter has a deformation property that allows the micro-shutter to be moved by an electrostatic force. For example, the micro-shutter display apparatus can adjust the position of its micro-shutter to transmit or block light. Accordingly, the micro-shutter display apparatus may have a fast response speed even though it is driven by a low voltage.

SUMMARY

According to an exemplary embodiment of the invention, a display apparatus includes a micro-shutter including a first electrode and a second electrode, a latch circuit including a first input node, a second input node, a first output node connected to the first electrode, and a second output node connected to the second electrode to receive an operation voltage and a common voltage, a capacitor including a first electrode and a second electrode applied with a shutter voltage, a first switching device applying a data signal to the first electrode of the capacitor in response to a gate signal, and a second switching device applying the voltage of the first electrode of the capacitor to the first input node of the latch circuit in response to an update voltage. The latch circuit is initialized when the operation voltage is set to a ground voltage and the common voltage is set to a first voltage level higher than the ground voltage. The common voltage is set to a second voltage level higher than the first voltage level after the latch circuit is initialized before the operation voltage is boosted to an activation level.

According to an exemplary embodiment of the invention, the first switching device includes a first transistor connected between a data line applied with the data signal and the first electrode of the capacitor and including a gate electrode applied with the gate signal.

According to an exemplary embodiment of the invention, the second switching device includes a second transistor connected between the first electrode of the capacitor and the first input node of the latch circuit and including a gate electrode applied with the update voltage.

According to an exemplary embodiment of the invention, the first input node is connected to the second output node and the second input node is connected to the second output node.

According to an exemplary embodiment of the invention, the latch circuit includes a third transistor connected between the operation voltage and the first output node and including a gate electrode connected to the first input node, a fourth transistor connected between the common voltage and the first output node and including a gate electrode connected to the first input node, a fifth transistor connected between the operation voltage and the second output node and including a gate electrode connected to the second input node, and a sixth transistor connected between the common voltage and the second output node and including a gate electrode connected to the second input node.

According to an exemplary embodiment of the invention, the third, fourth, fifth, and sixth transistors are turned off to initialize the latch circuit when the operation voltage is set to the ground voltage after the first switching device applies the data signal to the first electrode of the capacitor in response to the gate signal.

According to an exemplary embodiment of the invention, each of the third and fifth transistors is a PMOS transistor and each of the fourth and sixth transistors is an NMOS transistor.

According to an exemplary embodiment of the invention, the first voltage level of the common voltage is higher than a voltage level of a threshold voltage of each of the third and fifth transistors.

According to an exemplary embodiment of the invention, the micro-shutter includes a shutter applied with the shutter voltage and the shutter moves to one of the first and second electrodes of the micro-shutter in response to a voltage difference between the shutter voltage and a voltage level of each of the first and second electrodes.

According to an exemplary embodiment of the invention, the operation voltage is set to the ground voltage during the initialization of the latch circuit and set to a first activation level higher than the ground voltage during a predetermined time period after the update voltage is boosted to the activation level. In addition, the operation voltage is set to a second activation level higher than the first activation level after the update voltage is discharged to a deactivated level before the initialization of the latch circuit.

According to an exemplary embodiment of the invention, a method of driving a display apparatus including a micro-shutter including a first electrode and a second electrode includes applying a common voltage having a first voltage level to a latch circuit of the display apparatus, performing data-loading to transmit a data signal to a capacitor of the display apparatus applied with a shutter voltage in response to a gate signal, setting a voltage level of an operation voltage applied to the latch circuit to a ground voltage to initialize the latch circuit, boosting the common voltage to a second voltage level higher than the first voltage level, applying a voltage of the capacitor to a first input node of the latch circuit connected to one of the electrodes in response to an update voltage, and resetting the common voltage to the first voltage level.

According to an exemplary embodiment of the invention, the operation voltage is boosted to a first activation level during a predetermined time period after resetting the common voltage to the first voltage level, and the operation voltage is boosted to a second activation level higher than the first activation level.

According to an exemplary embodiment of the invention, the operation voltage is maintained at the second activation level during the data-loading.

According to an exemplary embodiment of the invention, the micro-shutter includes a shutter applied with the shutter voltage and the shutter moves to one of the first and second electrodes of the micro-shutter in response to a voltage difference between the shutter voltage and a voltage level of each of the first and second electrodes.

According to an exemplary embodiment of the invention, the first input node is connected to a first output node of the latch circuit connected to the first electrode and a second input node of the latch circuit is connected to an second output node connected to the second electrode.

According to an exemplary embodiment of the invention, the latch circuit includes a first transistor connected between the operation voltage and the first output node and including a gate electrode connected to the first input node, a second transistor connected between the common voltage and the first output node and including a gate electrode connected to the first input node, a third transistor connected between the operation voltage and the second output node and including a gate electrode connected to the second input node, and a fourth transistor connected between the common voltage and the second output node and including a gate electrode connected to the second input node. The first voltage level of the common voltage is higher than a voltage level of a threshold voltage of each of the first and third transistors.

According at least one embodiment of the invention, the common voltage applied to the pixel is set to the voltage level higher than the ground voltage.

According to an exemplary embodiment of the invention, a display apparatus includes a micro-shutter including a first electrode and a second electrode, a latch circuit having a first output node connected to the first electrode and a second output node connected to the second electrode, a capacitor applied with a shutter voltage, a first switching device applying a data signal to the capacitor in response to a gate signal, a second switching device applying a voltage of the capacitor to an input node of the latch circuit in response to an update voltage, and a voltage driver. The voltage driver is configured to sequentially apply an operation voltage of a ground voltage to the latch circuit to initialize the latch circuit, apply a common voltage to the latch circuit at a first voltage level higher than the ground voltage, apply the common voltage to the latch circuit at a second voltage level higher than the first voltage level, and then apply the operation voltage to the latch circuit boosted to an activation level.

According to an exemplary embodiment of the invention, the latch circuit includes a first PMOS transistor connected to a first signal line providing the operation voltage and the first electrode, a second PMOS transistor connected to the first signal line and the second electrode, a first NMOS transistor connected to a second signal line providing the common voltage and the first electrode, and a second NMOS transistor connected to the second signal line and the second electrode.

According to an exemplary embodiment of the invention, gates of the first PMOS transistor and the first NMOS transistor are connected together and to non-gate terminals of the second PMOS transistor and the second NMOS transistor, and gates of the second PMOS transistor and the second PMOS transistor are connected together and to non-gate terminals of the first NMOS transistor and the first PMOS transistor.

According to an exemplary embodiment of the invention, the display apparatus further includes a signal line supplying the shutter voltage to the capacitor and to a shutter of the micro-shutter located between the first and second electrodes, where application of the shutter voltage to the shutter moves the shutter towards one of the first and second electrodes.

BRIEF DESCRIPTION OF THE DRAWINGS

Exemplary embodiments of the present invention will become readily apparent by reference to the following detailed description when considered in conjunction with the accompanying drawings wherein.

DETAILED DESCRIPTION

It will be understood that when an element or layer is referred to as being "on", "connected to" or "coupled to" another element or layer, it can be directly on, connected or coupled to the other element or layer or intervening elements or layers may be present. Like numbers refer to like elements throughout.

As used herein, the singular forms, "a", "an" and "the" are intended to include the plural forms as well, unless the context clearly indicates otherwise. Hereinafter, exemplary embodiments of the present invention will be explained in detail with reference to the accompanying drawings.

Figure 1:
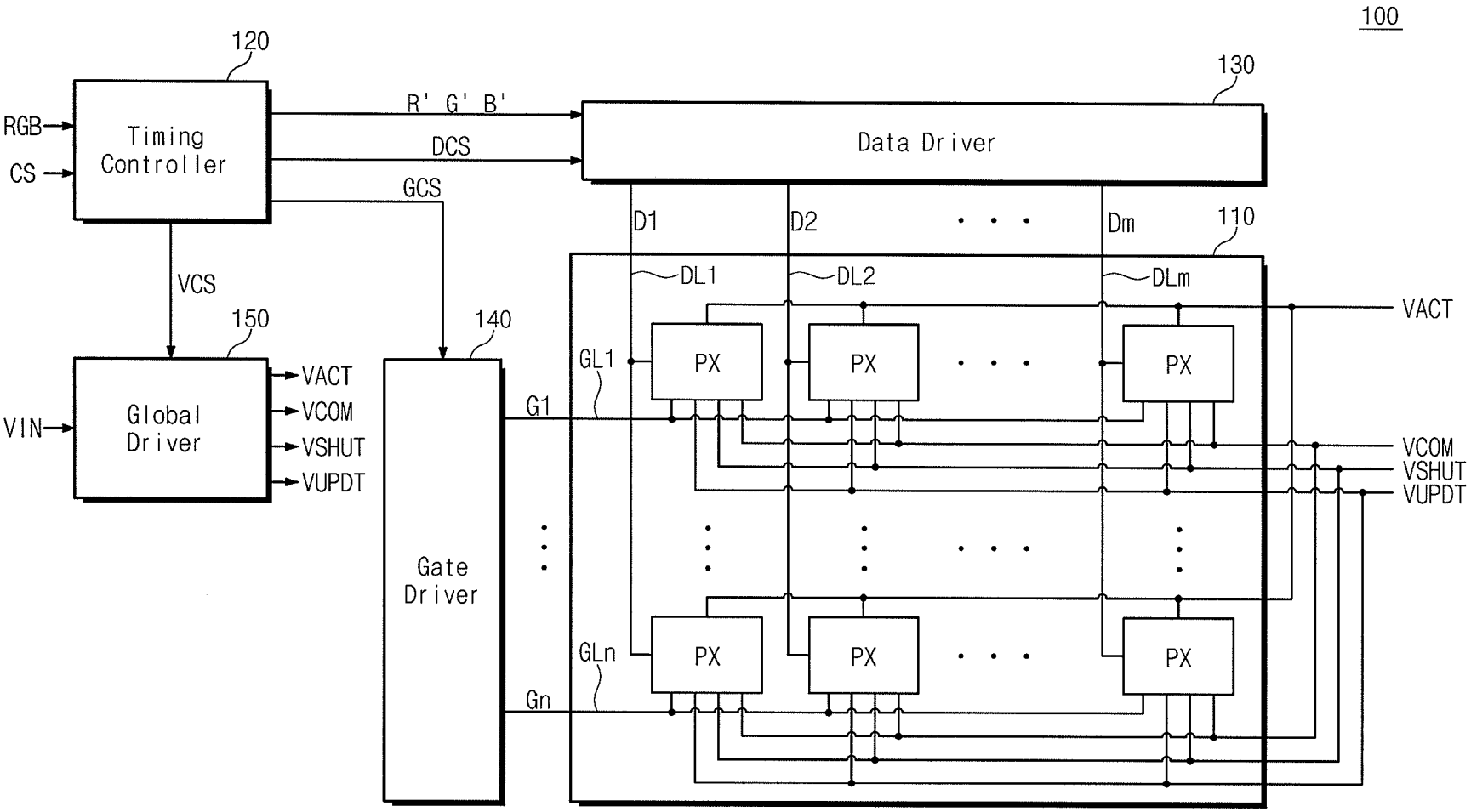
FIG. 1 is a block diagram showing a display apparatus according to an exemplary embodiment of the present invention.

FIG. 1 is a block diagram showing a display apparatus according to an exemplary embodiment of the present invention. Referring to FIG. 1, a display apparatus 100 includes a display panel 110, a timing controller 120, a data driver 130, a gate driver 140, and a global driver 150 (e.g., a voltage driver).

The timing controller 120 receives image signals RGB and a control signal CS from an external device (not shown). The timing controller 120 converts a data format of the image signals RGB into a data format that is appropriate for the data driver 130 and applies the converted image signals R'G'B' to the data driver 130. In an embodiment, the timing controller 120 applies a data control signal DCS, such as a vertical synchronization signal V_sync, an output start signal, a horizontal start signal, etc., to the data driver 130.

In an embodiment, the timing controller 120 applies a gate control signal GCS, such as a vertical start signal, a vertical clock signal, etc., to the gate driver 140.

The gate driver 140 may sequentially output gate signals G1 to Gn in response to the gate control signal GCS provided from the timing controller 120.

The data driver 130 converts the image signals R'G'B' into data signals D1 to Dm in response to the data control signal DCS provided from the timing controller 120. The gate signals G1 to Gn and the data signals D1 to Dm are applied to the display panel 110.

The display panel 110 includes a plurality of gate lines GL1 to GLn, a plurality of data lines DL1 to DLm crossing the gate lines GL1 to GLn, and a plurality of pixels PX connected to a corresponding gate line of the gate lines GL1 to GLn and a corresponding data line of the data lines DL1 to DLm. The display panel 110 further includes signal lines to apply an operation voltage VACT, a common voltage VCOM, a shutter voltage VSHUT, and an update voltage VUPDT to at least one pixel PX.

The gate lines GL1 to GLn are connected to the gate driver 140 and the data lines DL1 to DLm are connected to the data driver 130. The gate lines GL1 to GLn receive the gate signals G1 to Gn provided from the gate driver 140 and the data lines DL1 to DLm receive the data signals D1 to Dm provided from the data driver 130.

The global driver 150 receives an input voltage Vin (e.g., from an external source) and applies the operation voltage VACT, the common voltage VCOM, the shutter voltage VSHUT, and the update voltage VUPDT to the display panel 110 in response to the a control signal VCS from the timing controller 120.

Although not shown in FIG. 1, the display apparatus 100 may further include a backlight unit disposed adjacent the display panel 110 to supply the light to the display panel 110.

Figure 2:
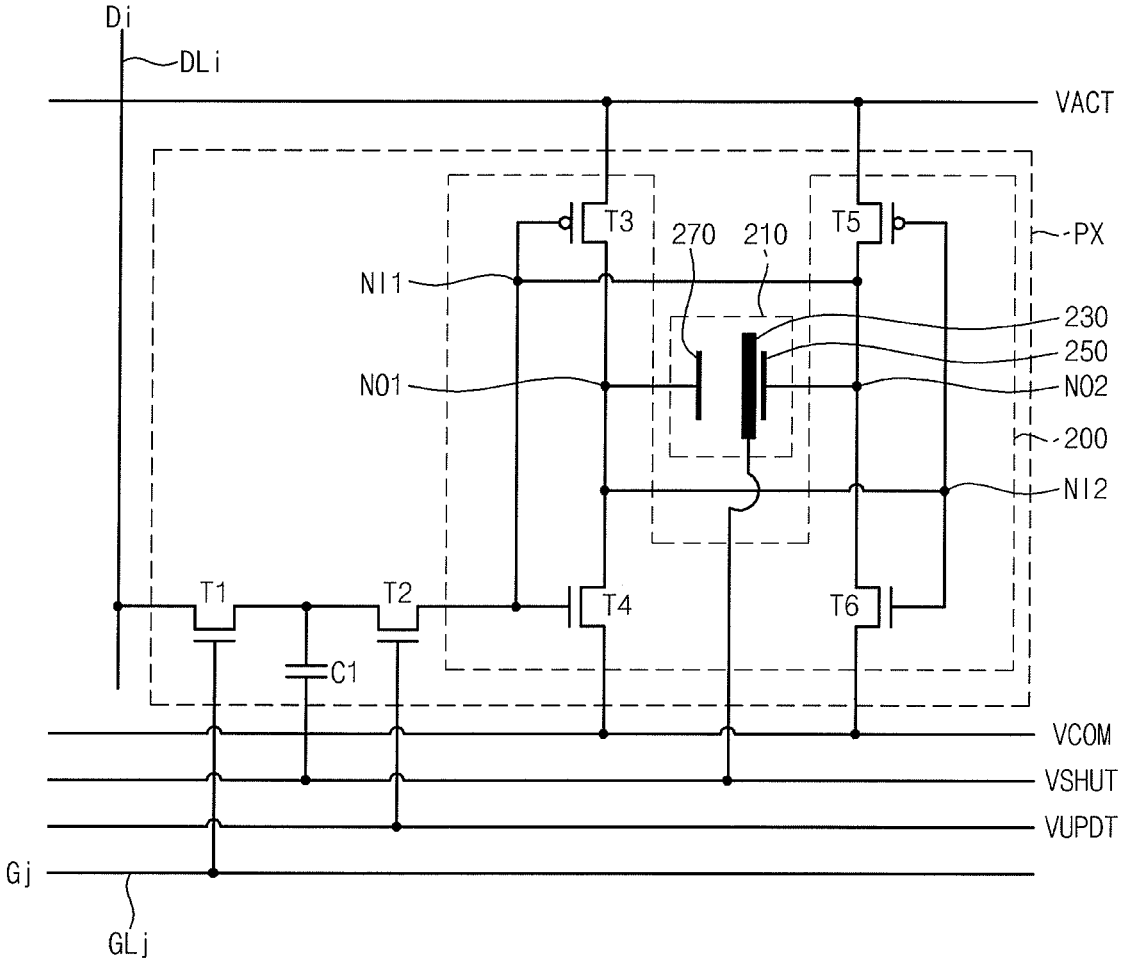
FIG. 2 is a circuit diagram showing a pixel shown in FIG. 1 according to an exemplary embodiment of the present invention.

FIG. 2 is a circuit diagram showing a pixel of FIG. 1 according to an exemplary embodiment of the invention. Referring to FIG. 2, the pixel PX includes a first switching device T1, a second switching device T2, a capacitor C1, and a latch circuit 200. In an exemplary embodiment, the pixel PX is connected to an i-th data line DLi of the data lines DL1 to DLm and a j-th gate line GLj of the gate lines GL1 to GLn.

The first switching device T1 is connected between the i-th data line DLi and a first electrode of the capacitor C1 and includes a gate electrode connected to the j-th gate line GLj. The second switching device T2 is connected between the first electrode of the capacitor C1 and a first input node NI1 of the latch circuit 200 and includes a gate electrode connected to a signal line applied with the update voltage VUPDT. In an exemplary embodiment, each of the first and second switching devices T1 and T2 are configured as NMOS transistors. The first electrode of the capacitor C1 is connected to a connection node between the first and second switching devices T1 and T2 and a second electrode of the capacitor C1 connected to a signal line applied with the shutter voltage VSHUT.

The latch circuit 200 includes third, fourth, fifth, and sixth transistors T3, T4, T5, and T6. The third transistor T3 is connected between a signal line applied with the operation voltage VACT and a first output node NO1 and includes a gate electrode connected to the first input node NI1. The fourth transistor T4 is connected between the first output node NO1 and a signal line applied with the common voltage VCOM and includes a gate electrode connected to the first input node NI1. The fifth transistor T5 is connected between the signal line applied with the operation voltage VACT and a second output node NO2 and includes a gate electrode connected to a second input node NI2. The sixth transistor T6 is connected between the second output node NO2 and the signal line applied with the common voltage VCOM and includes a gate electrode connected to the second input node NI2. In an exemplary embodiment, the third and fifth transistors T3 and T5 are configured as PMOS transistors and the fourth and sixth transistors T4 and T6 are configured as NMOS transistors. The third and fourth transistors T3 and T4 may be referred to as one pair of complimentary series transistors and the fifth and sixth transistors T5 and T6 may be referred to as another pair of complimentary series transistors.

The micro-shutter 210 includes a first electrode 250, a second electrode 270, and a shutter 230. The first electrode 250 may be referred to as a master electrode and the second electrode may be referred to as a slave electrode. In an embodiment, the first electrode 250 is connected to the second output node NO2 and the second electrode 270 is connected to the first output node NO1. The shutter 230 is located between the first electrode 250 and the second electrode 270 and is applied with the shutter voltage VSHUT.

Figure 3:
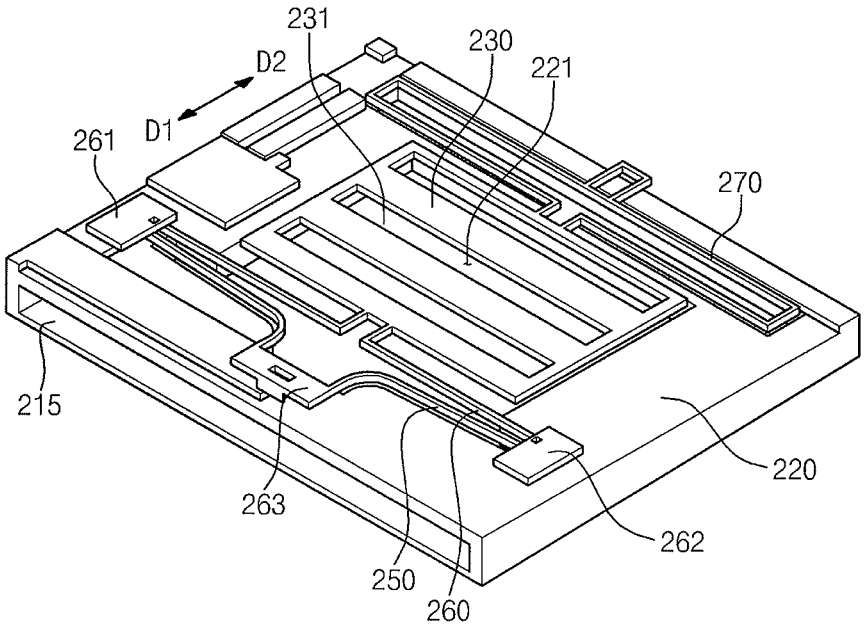
FIG. 3 is a perspective view showing a micro-shutter shown in FIG. 2 according to an exemplary embodiment of the present invention.

FIG. 3 is a perspective view showing a micro-shutter of FIG. 2 according to an exemplary embodiment of the invention. Referring to FIG. 3, the micro-shutter 210 includes a substrate 215, a reflection layer 220, the shutter 230, the first electrode 250, and the second electrode 270. The substrate 215 may be formed of a transparent insulating material, such as glass, plastic, crystal, etc.

The reflection layer 220 is located on the substrate 215 to reflect the light emitted from the backlight unit (not shown). The reflection layer 220 includes a plurality of first openings 221 formed therethrough. The first openings 221 are optical paths through which light travels. Light that travels through portions except for the first openings 221 may be reflected by the reflection layer 220. The first openings 221 transmit or block light in cooperation with second openings 231 formed through the shutter 230.

In an exemplary embodiment, the shutter 230 includes three second openings 231 and the three second openings 231 have the same size. However the invention is not limited thereto since there may a lesser or greater number of the second openings 231, and the sizes of the second openings 231 may differ from one another.

In an embodiment, the shutter 230 has a plate-like shape and is located substantially parallel to the substrate 215. In an embodiment, the shutter 230 includes an opaque material to block light traveling therethrough. In an exemplary embodiment, the number of the second openings 231 is equal to the number of the first openings 221 and the shape of the second openings 231 is the same as the shape of the first openings 221. However the invention is not limited thereto. For example, the number of and the shape of the first openings 221 may be different from those of the second openings 231.

In an embodiment, a flexible electrode 260 is located adjacent a side of the shutter 230 to allow the shutter 230 to move the first electrode 250 along a direction D1 (hereinafter, referred to as a first direction) to be disposed substantially parallel to a surface of the substrate 215. For example, the shutter 230 can move along the first direction D1 using the flexible electrode 260.

In an embodiment, the first electrode 250 is spaced apart from the flexible electrode 260 by a predetermined distance. For example, the flexible electrode 260 is located between the first electrode 250 and the shutter 230.

In an embodiment, the micro-shutter 210 further includes supporters 261, 262, and 263 to fix the first electrode 250 and the flexible electrode 260 on the reflection layer 220. In an embodiment, the supporters 261, 262, and 263 make contact with the substrate 215, on which the reflection layer 220 is located, to allow the flexible electrode 260 to be spaced apart from the reflection layer 220 and the substrate 215 by a predetermined distance while being moved.

Hereinafter, a method of driving the micro-shutter will be described in detail according to an exemplary embodiment of the invention.

In an embodiment where a first voltage is applied to the first input node NI1 and the shutter voltage VSHUT applied to the shutter 230 is zero (0) volts, the first electrode 250 and the flexible electrode 260 are spaced apart from each other. In this embodiment, since the first openings 221 are not overlapped with the second openings 231, the shutter 230 is maintained in a closed state and light is blocked by the shutter 230, thereby displaying a black color. The first voltage has the same voltage level (e.g., zero volts) as the shutter voltage VSHUT.

Accordingly, when the voltage level of the shutter voltage VSHUT is changed, the voltage level of the first voltage is changed to have the same voltage level as the shutter voltage VSHUT. When the second voltage is applied to the first input node NI1, the flexible electrode 260 connected to the shutter 230 is attracted to the first electrode 250 by an electrostatic force. The second voltage has a voltage level appropriate to move (attract) the flexible electrode 260 to the first electrode 250 by the electrostatic force between the first electrode 250 and the flexible electrode 260.

When the shutter 230 moves in the first direction D1, the shutter 230 is maintained in an opened state and light (e.g., from the backlight unit) is transmitted through the first openings 221 and the second openings 231, thereby displaying a white color.

Hereinafter, the voltage level of the shutter voltage VSHUT will be described as zero volts, but the voltage level of the shutter voltage VSHUT may be varied in alternate embodiments. For instance, the shutter voltage VSHUT may have the voltage level corresponding to the voltage level of the operation voltage VACT to attract the flexible electrode 260 to the first electrode 250 by the electrostatic force between the first electrode 250 and the flexible electrode 260. When the shutter voltage VSHUT has the voltage level corresponding to the voltage level of the operation voltage VACT, the movement of the shutter 230 caused by the data signal Di is opposite to the movement of the shutter 230 when the voltage level of the shutter voltage VSHUT is zero volts.

Figure 4:
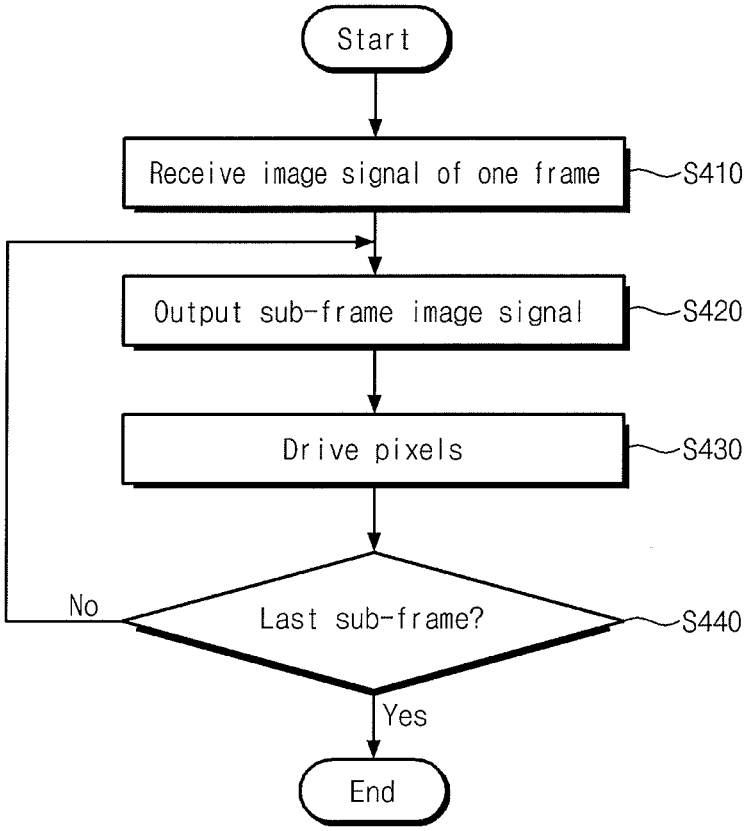
FIG. 4 is a flowchart showing an operation of the display apparatus shown in FIG. 1 according to an exemplary embodiment of the present invention.
Figure 5:
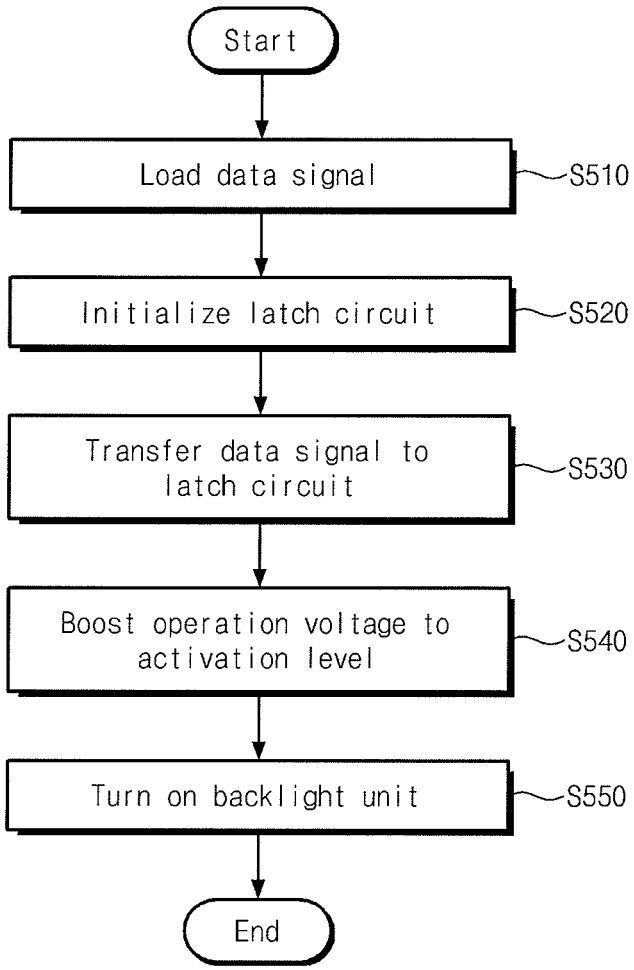
FIG. 5 is a flowchart showing an operation of the pixel shown in FIG. 2 according to an exemplary embodiment of the present invention.
Figure 6:
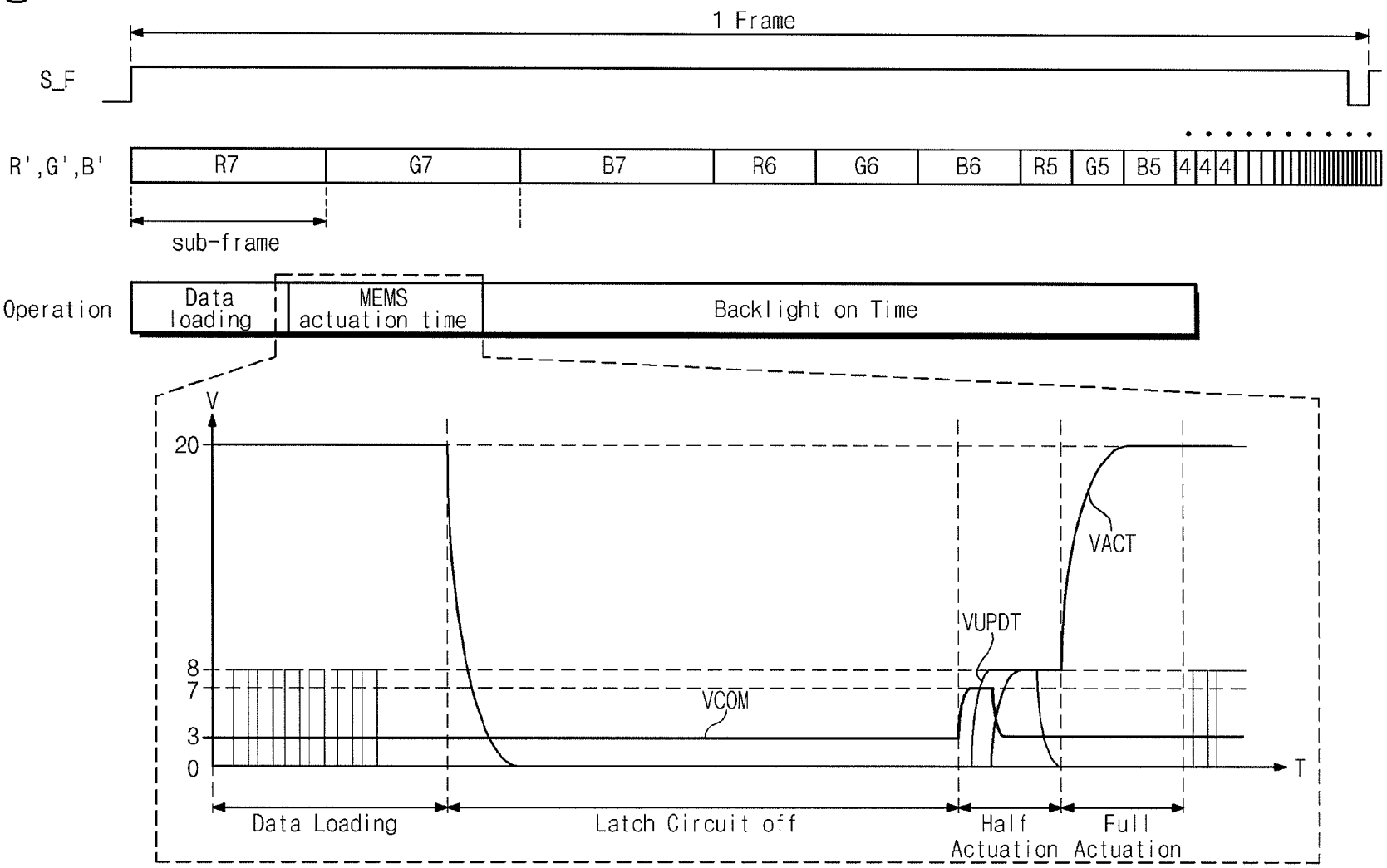
FIG. 6 is a timing diagram showing exemplary signals that may be used in the display apparatus shown in FIG. 1.

FIG. 4 is a flowchart showing an exemplary operation of the display apparatus shown in FIG. 1, FIG. 5 is a flowchart showing an exemplary operation of the pixel shown in FIG. 2, and FIG. 6 is a timing diagram exemplary showing signals that may be used in the display apparatus shown in FIG. 1.

Referring to FIGS. 4 to 6, the timing controller 120 of the display apparatus 100 receives the image signals RGB corresponding to one frame (S410). The image signals RGB include a red signal R, a green signal G, and a blue signal B. In an exemplary embodiment, each of the red, green, and blue signals R, G, and B is 8 bits. However, the invention is not limited thereto. For example, each colored signal may be less than or greater than 8 bits in alternate embodiments. Further, while FIG. 1 shows the timing controller 120 outputting red, green, and blue signals image signals to the data driver 130, in an alternate embodiment, the timing controller 120 outputs only grey level image signals (e.g., black and white images signals).

As discussed above, in an embodiment, the timing controller 120 converts the image signals RGB of one frame to the image signals R'G'B' having a data format that is appropriate for the data driver 130 and provides the converted image signals R'G'B' to the data driver 130. In an embodiment, the converted image signals R'G'B' output from the timing controller 120 are pulse width modulation (PWM) signals. In an embodiment, a 1-bit signal of each of the red signal R, the green signal G, and the blue signal B is output using a PWM scheme. The timing controller 120 applies the converted image signals R'G'B' using the PWM scheme after converting the red signal R, the green signal G, and the blue signal B one bit at a time (S420). In an embodiment, the timing controller 120 converts the red signal R, the green signal G, and the blue signal B sequentially from the most significant bit to the least significant bit. The 1-bit signal of each of the red signal R, the green signal G, and the blue signal B may be referred to as a sub-frame image signal. When the image signals RGB input to the timing controller 120 are represented at 24 bits, each of the red signal R, the green signal G, and the blue signal B is represented at 8 bits. In this embodiment, the image signals R'G'B' output from the timing controller 120 are provided to the data driver 130 in the order from the most significant bit of the red, green, and blue signals R, G, and B (e.g., an eighth bit R7 of the red signal R, an eighth bit G7 of the green signal G, and an eighth bit B7 of the blue signal B) to the least significant bit of the red, green, and blue signals R, G, and B (e.g., a first bit R0 of the red signal R, a first bit G0 of the green signal G, and a first bit B0 of the blue signal B).

The timing controller 120 applies the gate control signal GCS to the gate driver 140 and the control signal VCS to the global driver 150. The pixels PX in the display panel 110 are driven in response to the data signals D1 to Dm from the data driver 130, the gate signals G1 to Gn from the gate driver 140, the operation voltage VACT, the common voltage VCOM, the shutter voltage VSHUT, and the update voltage VUPDT (S430).

When a last sub-frame in the image signals RGB corresponding to the one frame is output to the data driver 130, the processing for the one frame by the timing controller 120 is completed (S440). However, if the last sub-frame has not been reached (e.g., another sub-frame is present in the image signals RGB of the one frame), the operation continues by outputting the next sub-frame image signal (S420).

Referring to FIGS. 2 and 5, the data signal Di is loaded to the capacitor C1 (S510). When the gate signal Gj applied through the gate line GLj is activated to a high level, the first switching device T1 is turned on. Accordingly, the data signal Di provided through the data line DLi is charged in the capacitor C1. The shutter voltage VSHUT is applied to the second electrode of the capacitor C1. In an exemplary embodiment, the shutter voltage VSHUT is set to a ground voltage (e.g., 0 volt).

During the data loading, the operation voltage VACT is maintained at a second activation level (e.g., 25 volts). When the data loading process has completed, the operation voltage VACT transitions to the ground voltage (e.g., 0 volt) and the latch circuit 200 is initialized (S520). In an embodiment where the latch circuit is initialized, the PMOS transistors T3 and T6 and the NMOS transistors T4 and T5 in the latch circuit 200 are turned off.

When a predetermined time lapses after the operation voltage VACT transitions to the ground voltage from the activation voltage, the common voltage VCOM is boosted to a second level (e.g., 7 volts) higher than a first level (S530). The second switching device T2 is turned on according to the boost of the update voltage VUPDT to the high level. Accordingly, the data signal charged in the capacitor C1 is transferred to the first input node NI1 of the latch circuit 200 through the second switching device T2.

The operation voltage VACT is boosted to the first activation level (e.g., 8 volts) higher than the ground voltage. After a predetermined time lapses, the operation voltage VACT is boosted to a second activation level higher than the first activation level (S540).

Each of the third to sixth transistors T3 to T6 is turned on or off according to the data signal applied to the first input node NI1. As a result, the operation voltage VACT is applied to one of the first and second output nodes NO1 and NO2, and thus the shutter 230 moves to the first electrode 250 or the second electrode 270.

Then, the backlight unit (not shown) is turned on after the position of the shutter 230 is set (S550). Since the light from the backlight unit is transmitted through the first and second openings 221 and 231 or is blocked, the display apparatus 100 may display the white color or the black color.

FIGS. 7A to 7E are circuit diagrams showing an exemplary operation of the pixel shown in FIG. 2 when a data signal has a first voltage.

Figure 7A:
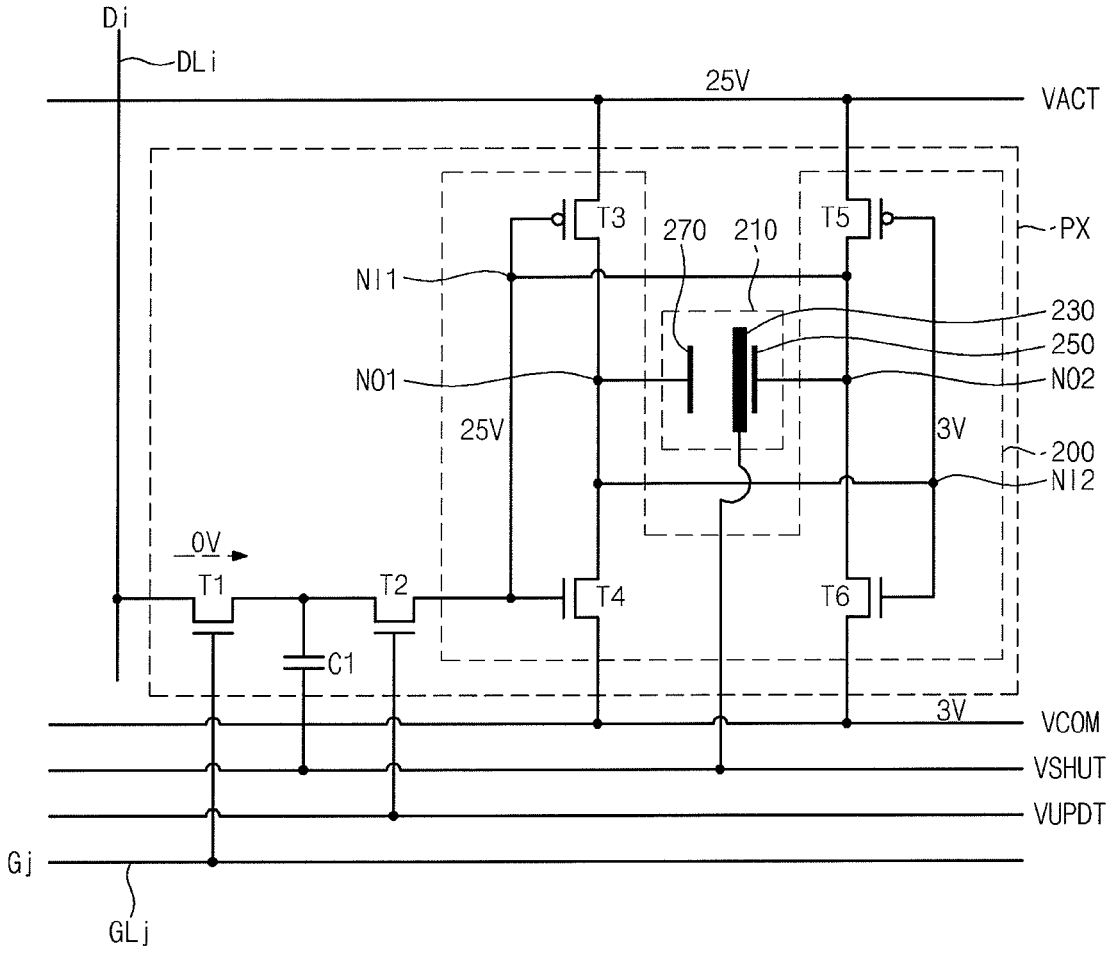
FIGS. 7A to 7E are circuit diagrams showing an exemplary operation of the pixel shown in FIG. 2 when a data signal has a first voltage.

FIG. 7A shows an example of a data loading process of the pixel of FIG. 2.

Referring to FIG. 7A, when the gate signal Gj (e.g., 8 volts) applied through the gate line GLj is activated to a high level, the first switching device T1 is turned on. Accordingly, the data signal Di at a first level (e.g., 0 volt), which is applied through the data line DLi, is charged in the capacitor C1. The second electrode of the capacitor C1 is applied with the shutter voltage VSHUT. In an exemplary embodiment, the shutter voltage VSHUT is set to the ground voltage (e.g., 0 volt).

In an example where the data signal Di has a second level (e.g., 7 volts) in a previous sub-frame, the first input node NI1 is maintained at a voltage corresponding to the operation voltage VACT (e.g., 25 volts) and the second input node NI2 is maintained at a voltage corresponding to the common voltage VCOM (e.g., 3 volts). Therefore, the third transistor T3 and the sixth transistor T6 are maintained in a turned-off state and the fourth transistor T4 and the fifth transistor T5 are maintained in a turned-on state.

Figure 7B:
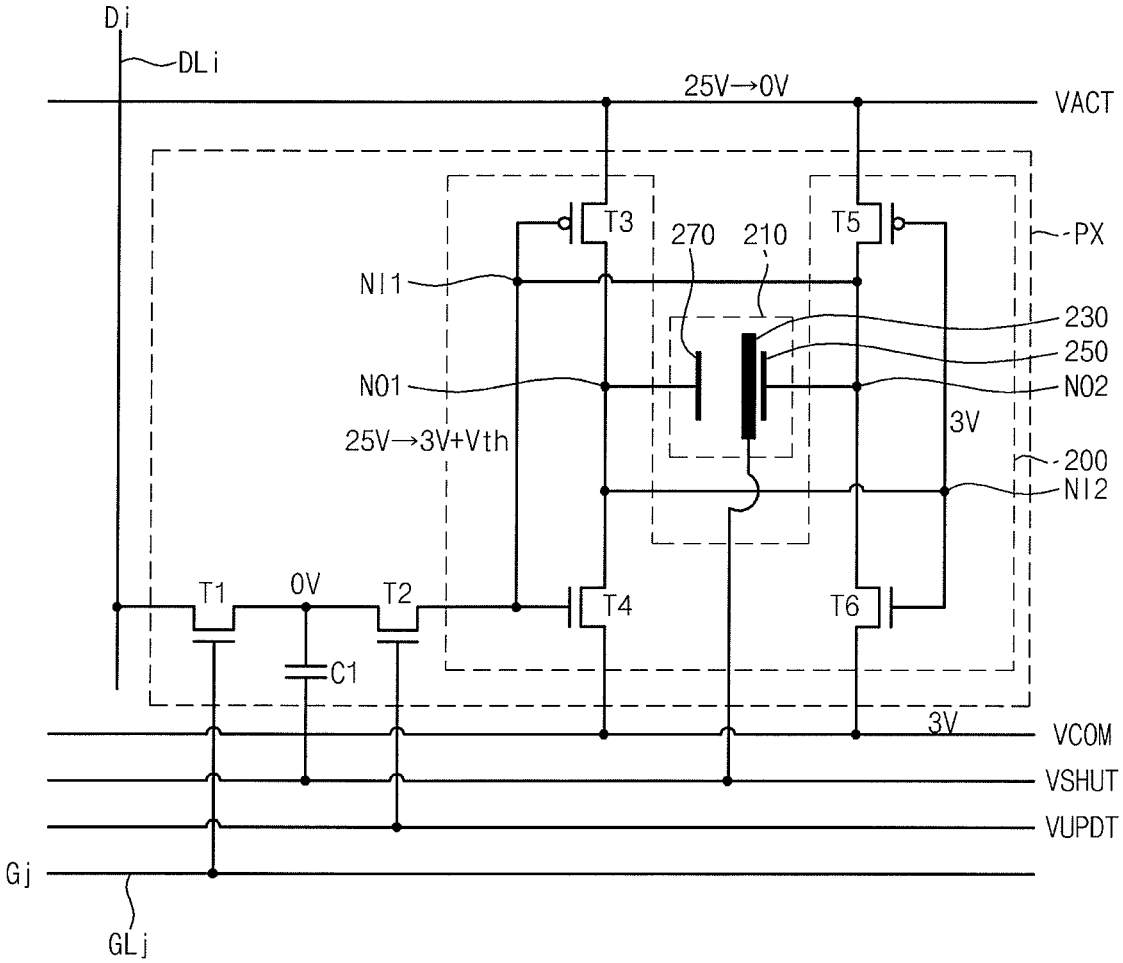

FIG. 7B shows an example of the initializing process of the latch circuit 200 in the pixel shown in FIG. 2.

Referring to FIG. 7B, when the data loading process in which the data signal Di is charged in the capacitor C1 has completed, the operation voltage VACT transitions to the ground voltage (e.g., 0 volt). As a result, the third, fifth, and sixth transistors T3, T5, and T6 are turned off and the fourth transistor T4 is turned on. In this example, the voltage level at the first input node NI1 is discharged to a lower voltage level (e.g., 3V+Vthp) from the voltage level of 25 volts.

Figure 7C:
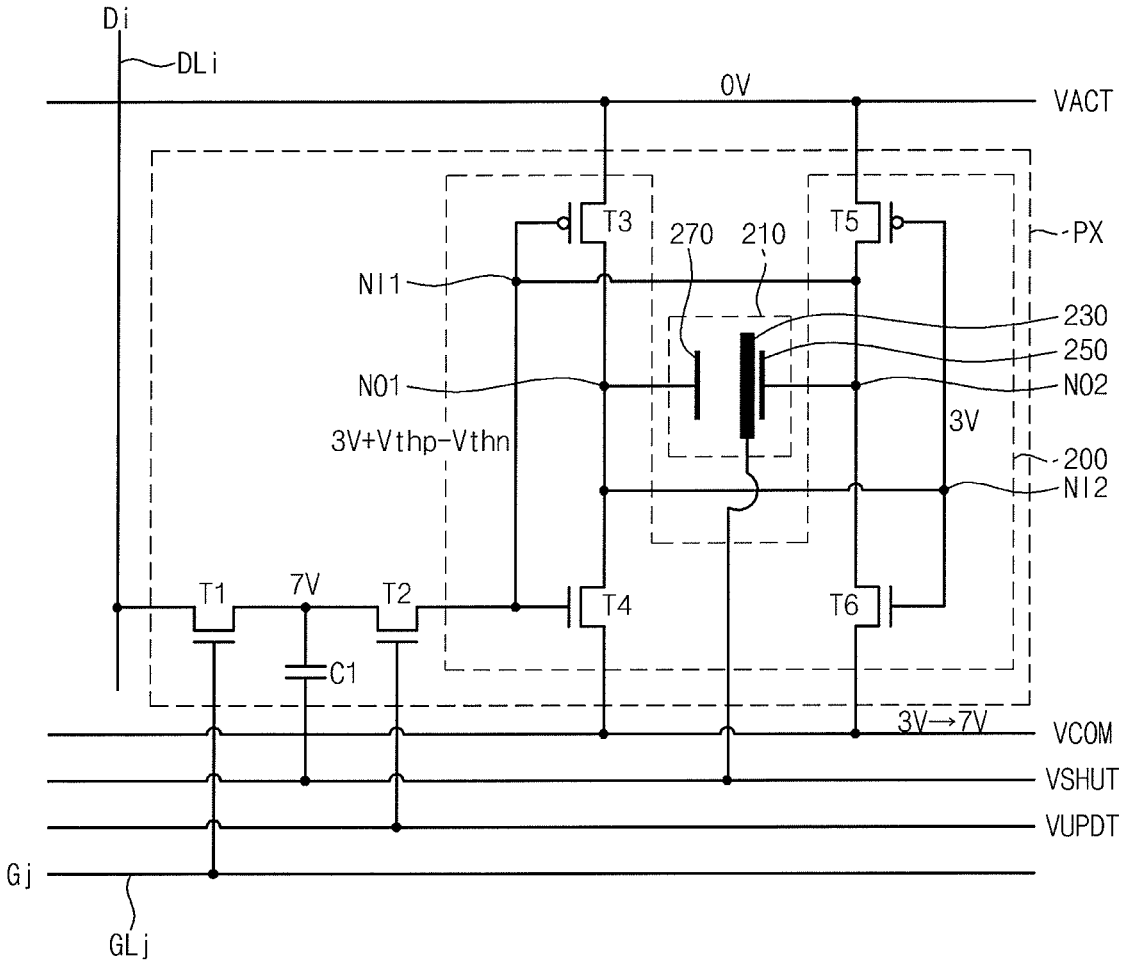

FIG. 7C shows an example of the operation applied to the pixel when the common voltage applied to the latch circuit 200 in the pixel shown in FIG. 2 is boosted to the second level.

Referring to FIG. 7C, when a predetermined time lapses after the operation voltage VACT transitions to 0 volt, the common voltage VCOM is boosted to the second level (e.g., 7 volts) higher than the first level (e.g., 3 volts). The fourth transistor T4 is turned off since a gate-source voltage Vgs of the fourth transistor T4 becomes lower than a threshold voltage Vthn of the fourth transistor T4.

Figure 7D:
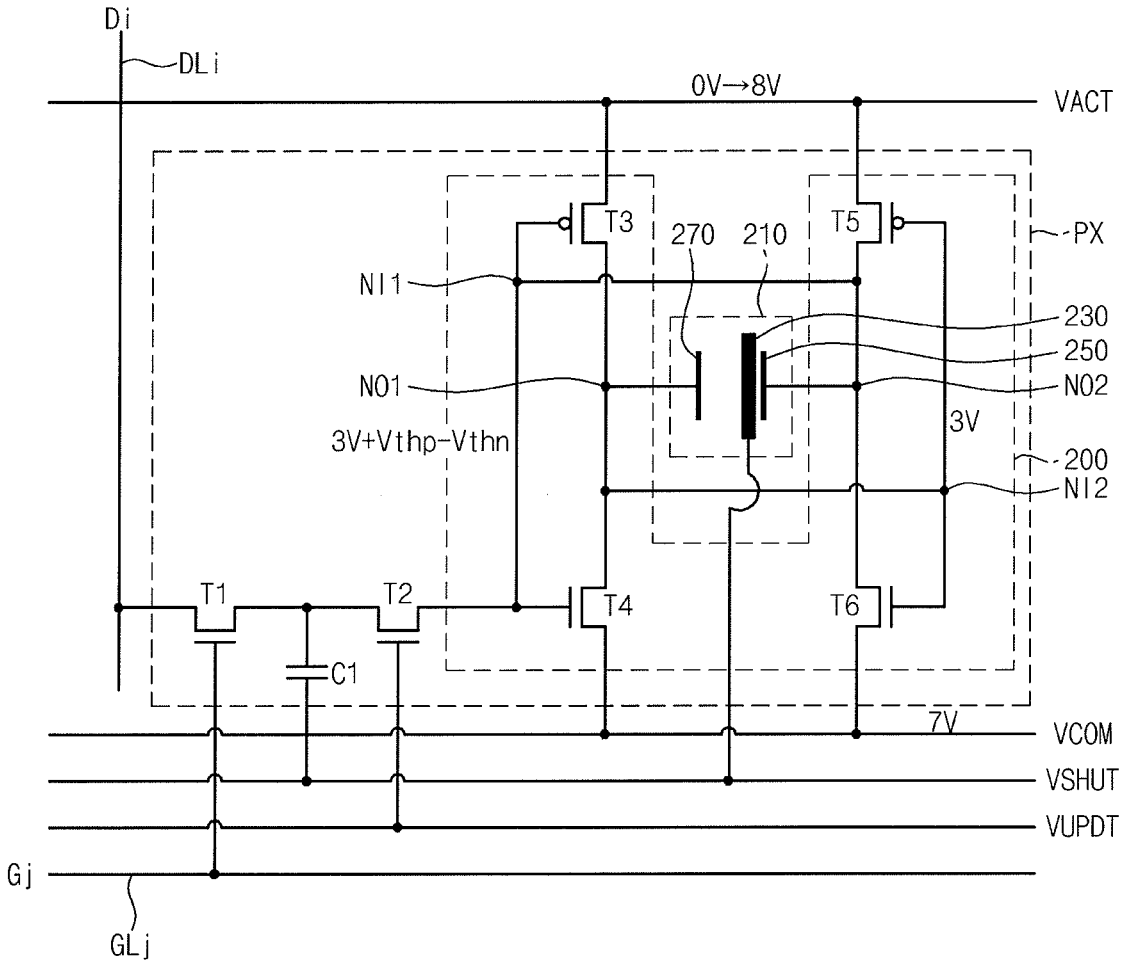

FIG. 7D shows an example of the operation applied to the pixel when the update voltage VUPDT applied to the latch circuit 200 in the pixel shown in FIG. 2 is boosted to the activation level.

Referring to FIG. 7D, the update voltage VUPDT is boosted to the activation level, and thus the second switching device T2 is turned on. Accordingly, the data signal Di charged in the capacitor C1 is applied to the first input node NI1 of the latch circuit 200 through the second switching device T2. The operation voltage VACT is boosted to the first activation level (e.g., 8 volts) from the ground voltage.

Figure 7E:
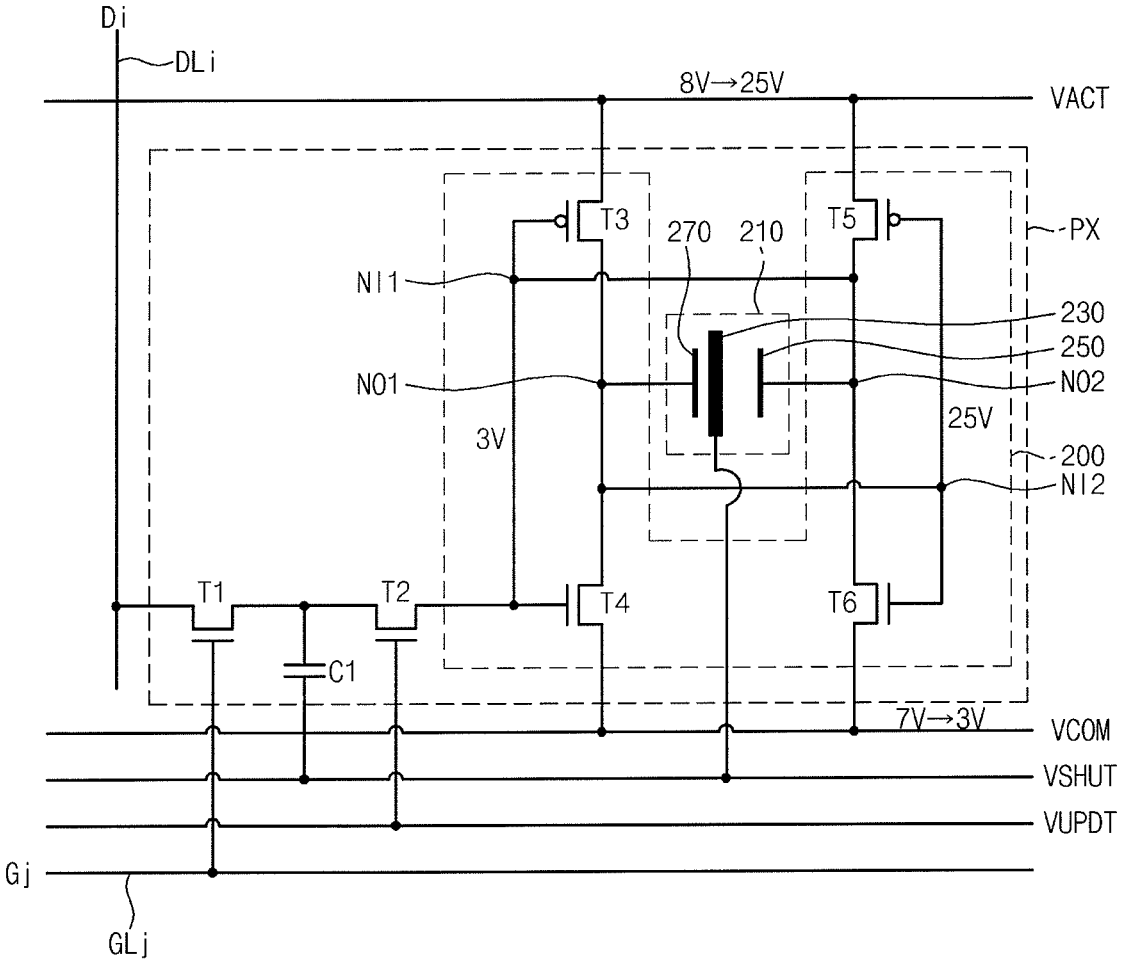

FIG. 7E shows an example of the movement of the shutter in the pixel shown in FIG. 2 due to the boosting of the operation voltage.

Referring to FIG. 7E, the operation voltage VACT is boosted to the second activation level (e.g., 25 volts) from the first activation level (e.g., 8 volts). Thus, responsive to the data signal Di at the first level (e.g., 0 volt), the third transistor T3 is turned on and the fourth transistor T4 is turned off. As a result, the voltage (e.g., 25 volts) corresponding to the operation voltage VACT is applied to the first output node NO1 through the third transistor T3. When the operation voltage VACT (e.g., of about 25 volts) is applied to the first output node N01, the fifth transistor T5 is turned off and the sixth transistor T6 is turned on, so that the common voltage VCOM (e.g. of about 3 volts) is applied to the second output node NO2.

When the common voltage VCOM (e.g., of about 3 volts) is applied to the first electrode 250 connected to the second output node NO2 and the shutter voltage VSHUT applied to the shutter 230 is about 0 volt, the shutter 230 moves to the second electrode 270. When the shutter 230 moves to the second electrode 270, the light provided from the backlight unit is not transmitted through the first and second openings 221 and 231, thereby displaying the black color. For example, the black color corresponding to the data signal Di at the first voltage of about 0 volt is displayed on the pixel PX.

FIGS. 8A to 8E are circuit diagrams showing an exemplary operation of the pixel shown in FIG. 2 when a data signal has a second voltage.

Figure 8A:
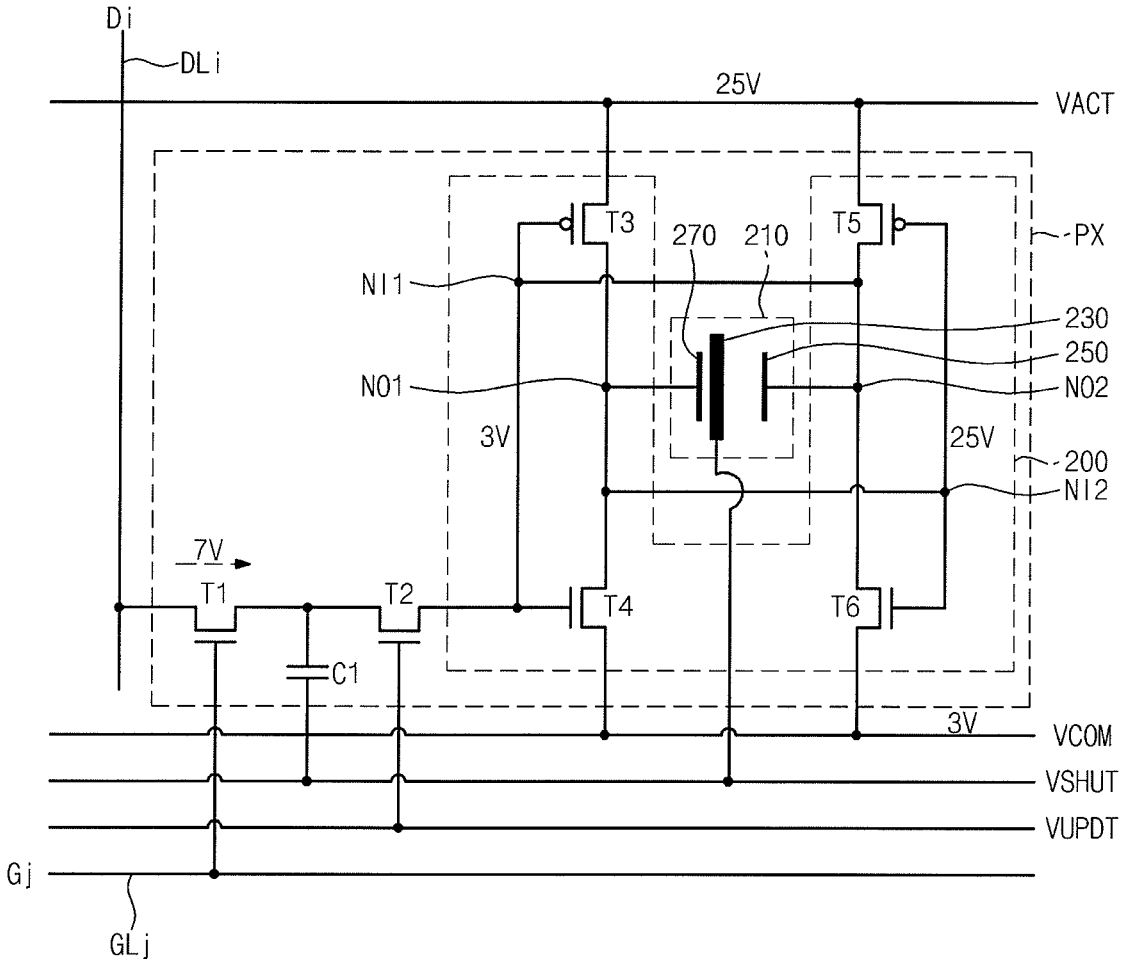
FIGS. 8A to 8E are circuit diagrams showing an exemplary operation of the pixel shown in FIG. 2 when a data signal has a second voltage.

FIG. 8A shows an example of the data loading process of the pixel shown in FIG. 2.

Referring to FIG. 8A, when the gate signal Gj applied through the gate line GLj is activated to a high level (e.g., of about 8 volts), the first switching device T1 is turned on. Accordingly, the data signal Di of about 7 volts applied through the data line DLi is charged in the capacitor C1. The second electrode of the capacitor C1 is applied with the shutter voltage VSHUT. In an exemplary embodiment, the shutter voltage VSHUT is set to the ground voltage (e.g., about 0 volts).

In an example where the data signal Di is a first level (e.g., of about 0 volts) in the previous sub-frame, the first input node NI1 is maintained at about 3 volts corresponding to the common voltage VCOM and the second input node NI2 is maintained at about 25 volts corresponding to the operation voltage VACT. Therefore, the fourth transistor T4 and the fifth transistor T5 are turned off and the third transistor T3 and the sixth transistor T6 are turned on.

Figure 8B:
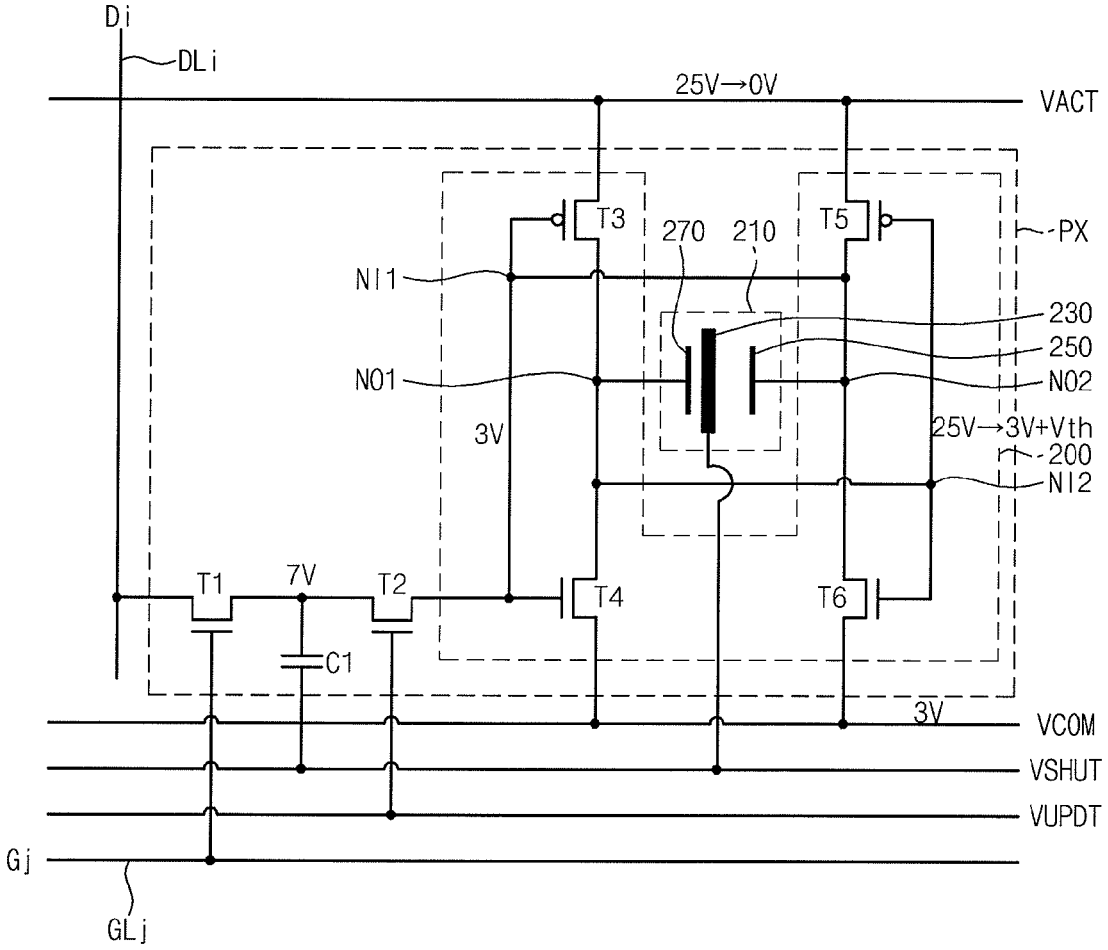

FIG. 8B shows an example of the initializing process of the latch circuit 200 in the pixel shown in FIG. 2.

Referring to FIG. 8B, when the data loading process in which the data signal Di is charged in the capacitor C1 has completed, the operation voltage VACT transitions to the ground voltage (e.g., about 0 volts). Thus, the fourth and fifth transistors T4 and T5 are maintained in the turned-off state, the third transistor T3 is turned off, and the sixth transistor T6 is maintained in the turned-on state. In this example, the voltage level at the second input node N12 transitions to a voltage level (e.g., 3V+Vthp) from the voltage level of about 25 volts. The 'Vthp' denotes a threshold voltage of the fifth transistor T5.

Figure 8C:
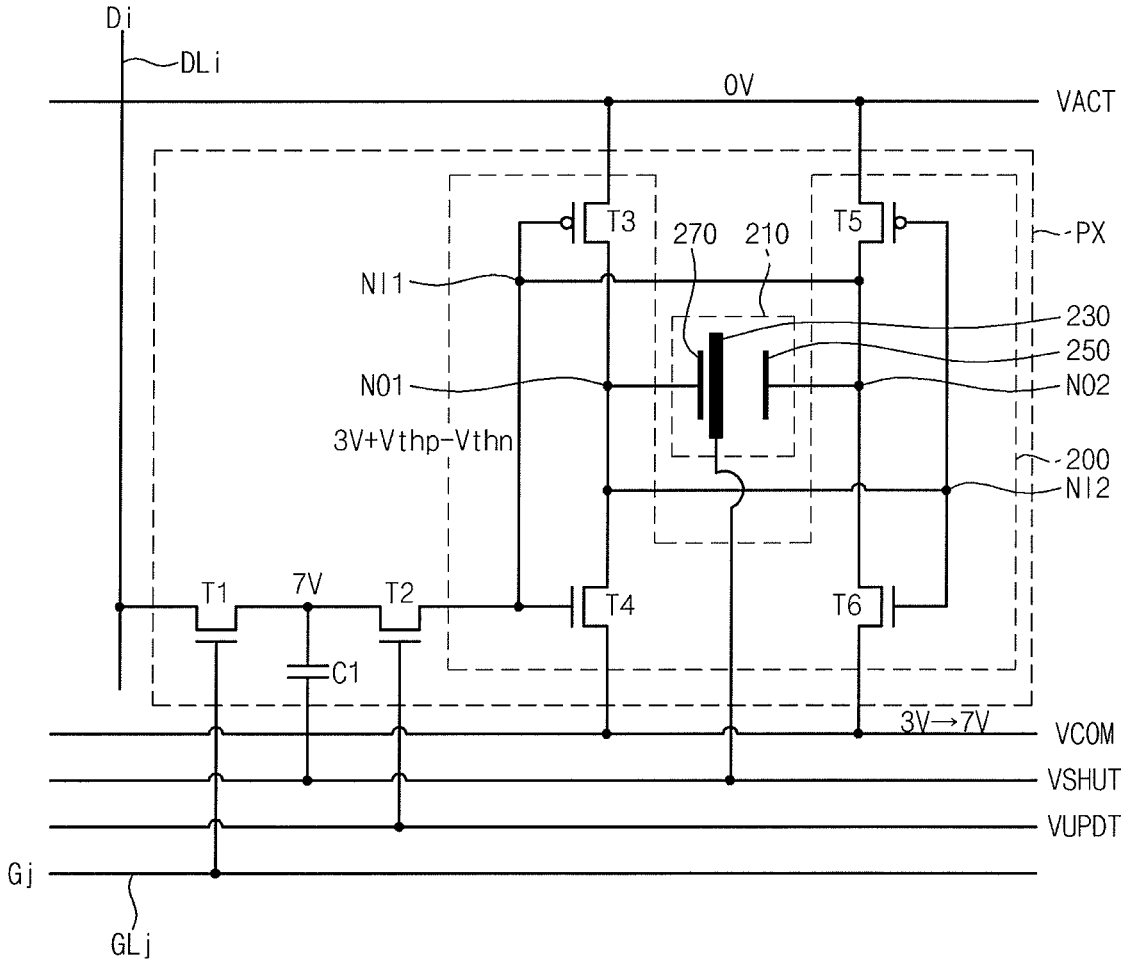

FIG. 8C shows an example of the boosting process of the common voltage VCOM applied to the latch circuit 200 in the pixel shown in FIG. 2.

Referring to FIG. 8C, the common voltage VCOM is boosted to a second level (e.g., about 7 volts) higher than a first level (e.g., about 3 volts) after the operation voltage VACT is lowered to about 0 volts. Since a gate-source voltage Vgs of the sixth transistor T6 becomes lower than a threshold voltage Vthn of the sixth transistor T6, the sixth transistor T6 is turned off. In addition, the voltage level at the first input node NI1 transitions to a voltage level of about 3V+Vthp−Vthn from the voltage level of about 25 volts. In an exemplary embodiment, Vthp denotes the threshold voltage of the fifth transistor T5 and Vthn denotes the threshold voltage of the sixth transistor T6.

Figure 8D:
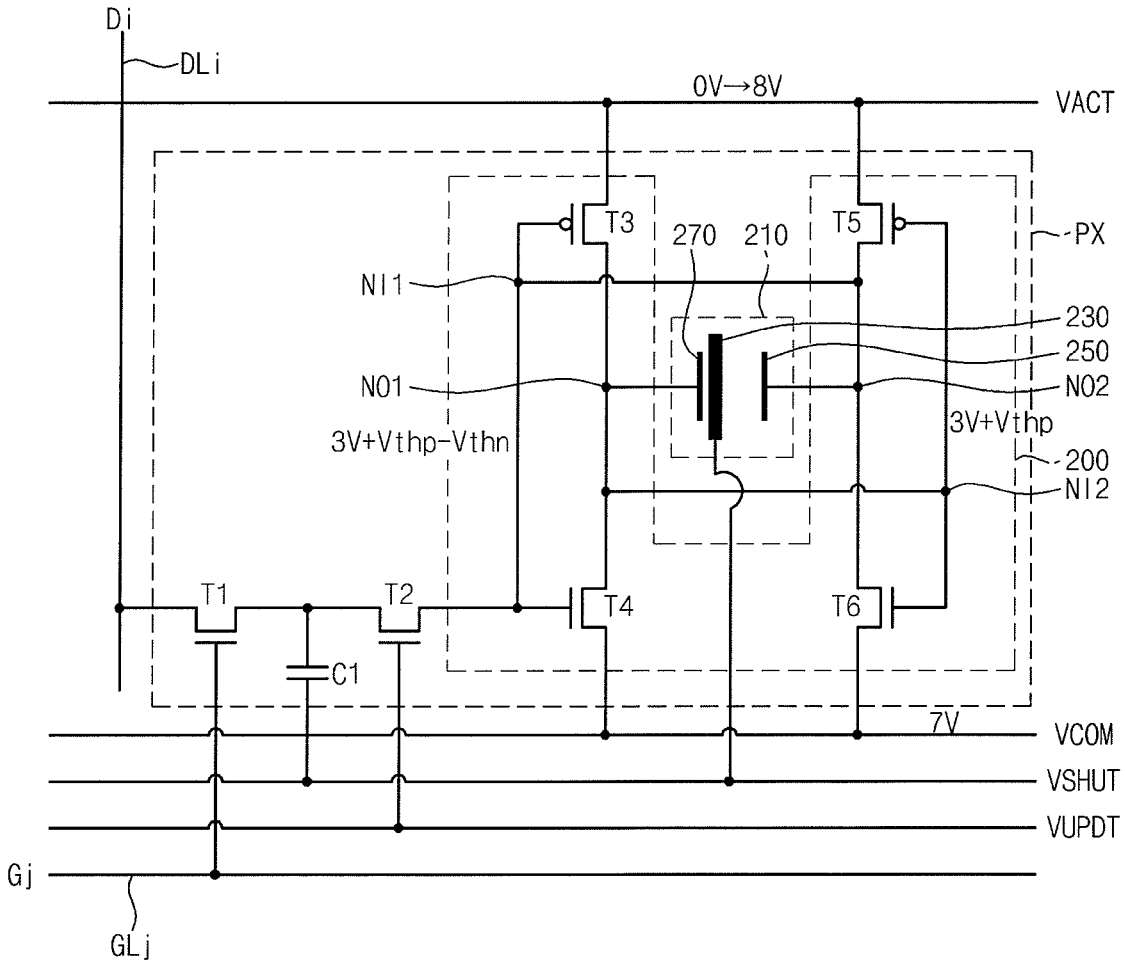

FIG. 8D shows an exemplary operation of the pixel when the update voltage applied to the latch circuit 200 in the pixel shown in FIG. 2 is boosted to the activation level.

Referring to FIG. 8D, the update voltage VUPDT is boosted to the activation level, and thus the second switching device T2 is turned on. Accordingly, the data signal Di charged in the capacitor C1 is applied to the first input node NH of the latch circuit 200 through the second switching device T2. The operation voltage VACT is boosted to the first activation level of about 8 volts from the ground voltage.

Figure 8E:
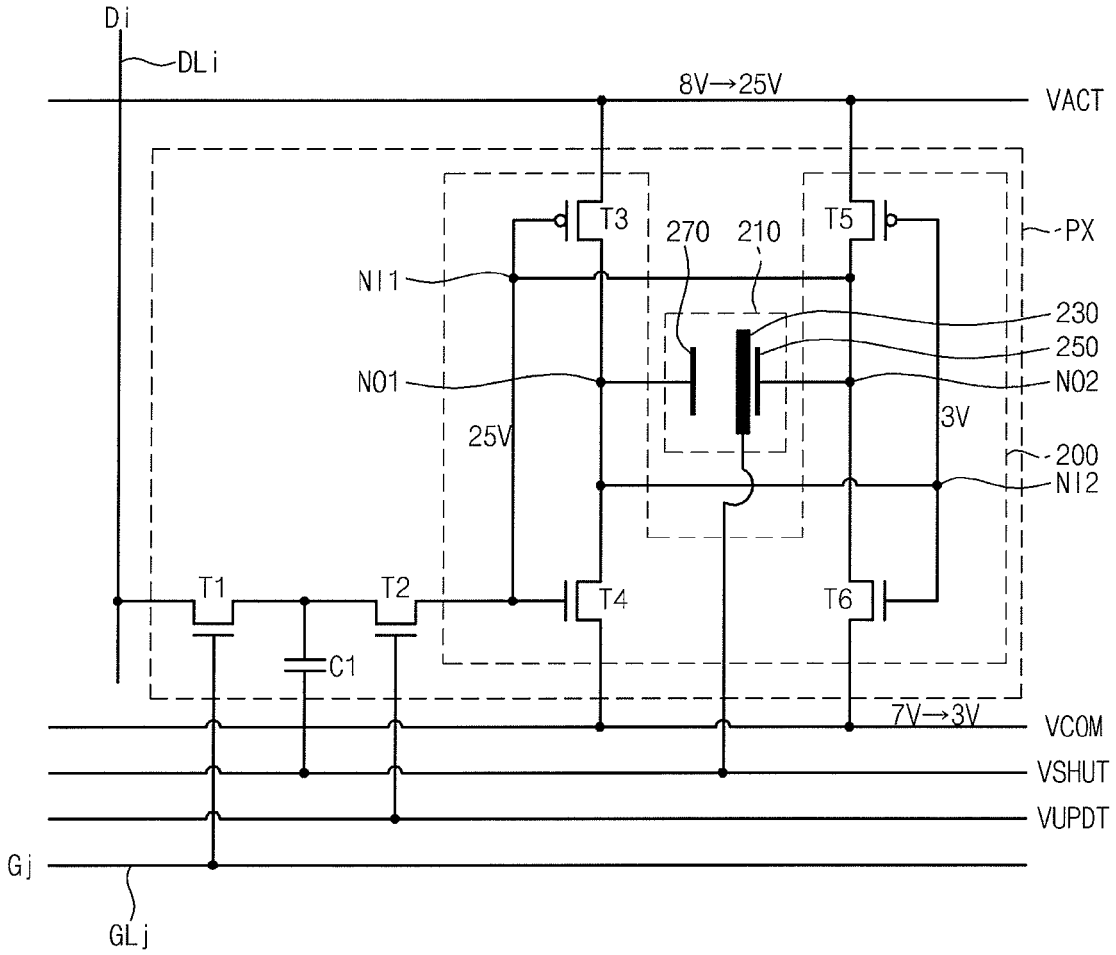

FIG. 8E shows an example of the movement of the pixel shown in FIG. 2 by the boost of the operation voltage.

Referring to FIG. 8E, the operation voltage VACT is boosted to the second activation level of about 25 volts from the first activation level of about 8 volts. When the operation voltage VACT is boosted, the third transistor T3 is turned off and the fourth transistor T4 is turned on due to the data signal Di applied to the first input node NI1. According to the turn-on of the fourth transistor T4, the voltage level at the first input node NI2 is discharged to the voltage level of the common voltage VCOM. As a result, the fifth transistor T5 is turned on and the sixth transistor T6 is turned off. Thus, the voltage level at the first input node NI1 increases to the voltage level of the operation voltage VACT, the voltage level at the first output node NO1 is maintained at the voltage level of the common voltage VCOM, and the voltage level at the second output node NO2 is maintained at the operation voltage VACT.

The second electrode 270 of the micro-shutter 210 connected to the first output node NO1 is applied with the voltage level of the common voltage VCOM and the first electrode 250 of the micro-shutter 210 connected to the second output node NO2 is applied with the voltage level of the operation voltage VACT. Due to the voltage difference between the voltage level of about 25 volts of the operation voltage VACT applied to the first electrode 250 and the voltage level of about 0 volts of the shutter voltage VSHUT applied to the shutter 230, an electrostatic force occurs between the first electrode 250 and the shutter 230. Thus, the shutter 230 moves to the first electrode 250 applied with the operation voltage VACT. When the shutter 230 moves to the first electrode 250, the shutter 230 is maintained in the opened state and the light provided from the backlight unit is transmitted through the first openings 221 and the second openings 231, thereby displaying the white color. For example, the white color corresponding to the data signal Di at the second voltage of about 7 volts is displayed on the pixel PX.

When the common voltage VCOM is maintained at about 0 volts during the initializing process of the latch circuit 200 shown in FIGS. 7B and 7C, the voltage level at the first input node NI1 is maintained at a voltage level, which is boosted by the threshold voltage Vthp, by the threshold voltage Vthp of the fifth transistor T5. Thus, although the data signal Di of about 0 volts is applied to the first input node NI1, the third transistor T3 is maintained in the turned-off state by the voltage level of the first input node NI1 boosted by the threshold voltage Vthp and the fourth transistor T4 is turned on. Consequently, the shutter 230 may malfunction.

In an exemplary embodiment, the voltage level of the common voltage VCOM is set to the first level (e.g., of about 3 volts) higher than the threshold voltage Vthp of the fifth transistor T5 during the operation of the pixel PX. When the common voltage VCOM is set to the first level, the fourth transistor T4 shown in FIG. 7B is maintained in the turned-on state and the sixth transistor T6 shown in FIG. 8B is maintained in the turned-on state. In an example where the data signal Di is the second level of about 7 volts, the voltage level of the first input node NI1 is discharged by the sixth transistor T6, and thus the shutter 230 may not move to the first electrode 250.

In an exemplary embodiment, the voltage level of the common voltage VCOM is temporarily set to the second level (e.g., of about 7 volts) higher than the first level as shown in FIGS. 7C and 8C. Thus, the fourth transistor T4 maintained in the turned-on state in FIG. 7B and the sixth transistor T6 maintained in the turned-on state in FIG. 8B may be turned off. As a result, the shutter 230 may be prevented from malfunctioning, thereby improving the image quality.

Please note that the above provided voltages are merely examples. Embodiments of the invention are not intended to be limited thereto. For example, while the above described a common voltage VCOM as being set to voltage levels of 3 and 7 volts, the settings of the common voltage VCOM may vary in alternate embodiments (e.g., {3.5 and 7 volts}, {4 and 8 volts}, {4 and 8.5 volts}, etc.). While the above described the operation voltage VACT as being set to 0, 8, and 25 volts, the settings of the operation voltage VACT may vary in alternate embodiments (e.g., {0, 8, and 20 volts), {−1, 8, and 25 volts}, etc.).

In an exemplary embodiment, a color filter (e.g., red, green, blue color filters) is placed over one or more of the pixels PX. For example, light passing through an open shutter and then though a red color filter appears red, light passing through an open shutter and then through a green color filter appears green, etc. In an embodiment, the color filter is a Bayer filter mosaic.

Although exemplary embodiments of the present invention have been described, it is understood that the present invention is not limited to these exemplary embodiments, but various changes and modifications can be made within the spirit and scope of the disclosure.

What is claimed is:

1. A display apparatus comprising:

a micro-shutter including a first electrode and a second electrode;

a latch circuit including a first input node, a second input node, a first output node connected to the first electrode, and a second output node connected to the second electrode to receive an operation voltage and a common voltage;

a capacitor including a first electrode and a second electrode applied with a shutter voltage;

a first switching device applying a data signal to the first electrode of the capacitor in response to a gate signal; and a second switching device applying a voltage of the first electrode of the capacitor to the first input node of the latch circuit in response to an update voltage, wherein the latch circuit is initialized when the operation voltage is set to a ground voltage, the common voltage is set to a first voltage level higher than the ground voltage, and the common voltage is set to a second voltage level higher than the first voltage level after the latch circuit is initialized before the operation voltage is boosted to an activation level.

2. The display apparatus of claim 1, wherein the first switching device comprises a first transistor connected between a data line applied with the data signal and the first electrode of the capacitor and including a gate electrode applied with the gate signal.

3. The display apparatus of claim 1, wherein the second switching device comprises a second transistor connected between the first electrode of the capacitor and the first input node of the latch circuit and including a gate electrode applied with the update voltage.

4. The display apparatus of claim 1, wherein the first input node is connected to the second output node and the second input node is connected to the second output node.

5. The display apparatus of claim 4, wherein the latch circuit comprises:

a third transistor connected between the operation voltage and the first output node and including a gate electrode connected to the first input node;

a fourth transistor connected between the common voltage and the first output node and including a gate electrode connected to the first input node;

a fifth transistor connected between the operation voltage and the second output node and including a gate electrode connected to the second input node; and a sixth transistor connected between the common voltage and the second output node and including a gate electrode connected to the second input node.

6. The display apparatus of claim 5, wherein the third, fourth, fifth, and sixth transistors are turned off to initialize the latch circuit when the operation voltage is set to the ground voltage after the first switching device applies the data signal to the first electrode of the capacitor in response to the gate signal.

7. The display apparatus of claim 5, wherein each of the third and fifth transistors is a PMOS transistor and each of the fourth and sixth transistors is an NMOS transistor.

8. The display apparatus of claim 7, wherein the first voltage level of the common voltage is higher than a voltage level of a threshold voltage of each of the third and fifth transistors.

9. The display apparatus of claim 1, wherein the micro-shutter comprises a shutter applied with the shutter voltage and the shutter moves to one of the first and second electrodes of the micro-shutter in response to a voltage difference between the shutter voltage and a voltage level of each of the first and second electrodes.

10. The display apparatus of claim 1, wherein the operation voltage is set to the ground voltage during the initialization of the latch circuit, is set to a first activation level higher than the ground voltage during a predetermined time period after the update voltage is boosted to the activation level, and is set to a second activation level higher than the first activation level after the update voltage is discharged to an deactivated level before the initialization of the latch circuit.

11. A method of driving a display apparatus comprising a micro-shutter including a first electrode and a second electrode, the method comprising:

performing data-loading to transmit a data signal to a capacitor of the display apparatus applied with a shutter voltage in response to a gate signal;

setting a voltage level of an operation voltage applied to a latch circuit of the display apparatus to a ground voltage and applying a common voltage to the latch circuit having a first voltage level higher than the ground voltage, to initialize the latch circuit;

boosting the common voltage to a second voltage level higher than the first voltage level;

applying a voltage of the capacitor to a first input node of the latch circuit connected to one of the electrodes in response to an update voltage; and resetting the common voltage to the first voltage level.

12. The method of claim 11, further comprising:

boosting the operation voltage to a first activation level during a predetermined time period after resetting the common voltage to the first voltage level; and boosting the operation voltage to a second activation level higher than the first activation level.

13. The method of claim 12, wherein the operation voltage is maintained at the second activation level during the data-loading.

14. The method of claim 11, wherein the micro-shutter comprises a shutter applied with the shutter voltage and the shutter moves to one of the first and second electrodes of the micro-shutter in response to a voltage difference between the shutter voltage and a voltage level of each of the first and second electrodes.

15. The method of claim 11, wherein the first input node is connected to a first output node of the latch circuit connected to the first electrode and the latch circuit includes a second input node connected to a second output node of the latch circuit that is connected to the second electrode.

16. The method of claim 15, wherein the latch circuit comprises:

a first transistor connected between the operation voltage and the first output node and including a gate electrode connected to the first input node;

a second transistor connected between the common voltage and the first output node and including a gate electrode connected to the first input node;

a third transistor connected between the operation voltage and the second output node and including a gate electrode connected to the second input node; and a fourth transistor connected between the common voltage and the second output node and including a gate electrode connected to the second input node, wherein the first voltage level of the common voltage is higher than a voltage level of a threshold voltage of each of the first and third transistors.

17. A display apparatus comprising:

a micro-shutter including a first electrode and a second electrode;

a latch circuit having a first output node connected to the first electrode and a second output node connected to the second electrode; a capacitor applied with a shutter voltage;

a first switching device applying a data signal to the capacitor in response to a gate signal;

a second switching device applying a voltage of the capacitor to an input node of the latch circuit in response to an update voltage; and a voltage driver configured to sequentially apply an operation voltage of a ground voltage to the latch circuit to initialize the latch circuit, apply a common voltage to the latch circuit at a first voltage level higher than the ground voltage, apply the common voltage to the latch circuit at a second voltage level higher than the first voltage level, and then apply the operation voltage to the latch circuit boosted to an activation level.

18. The display apparatus of claim 17, wherein the latch circuit comprises:

a first PMOS transistor connected to a first signal line providing the operation voltage and the first electrode;

a second PMOS transistor connected to the first signal line and the second electrode;

a first NMOS transistor connected to a second signal line providing the common voltage and the first electrode; and a second NMOS transistor connected to the second signal line and the second electrode.

19. The display apparatus of claim 18, wherein gates of the first PMOS transistor and the first NMOS transistor are connected together and to non-gate terminals of the second PMOS transistor and the second NMOS transistor, wherein gates of the second PMOS transistor and the second PMOS transistor are connected together and to non-gate terminals of the first NMOS transistor and the first PMOS transistor.

20. The display apparatus of claim 18, further comprising a signal line supplying the shutter voltage to the capacitor and to a shutter of the micro-shutter located between the first and second electrodes, wherein application of the shutter voltage to the shutter moves the shutter towards one of the first and second electrodes.

* * * * *